US012104323B2

(12) United States Patent
Wilkie et al.

(10) Patent No.: US 12,104,323 B2
(45) Date of Patent: Oct. 1, 2024

(54) SEAMED PRESS FELT WITH PARTIALLY ANCHORED STUFFER YARN PACKAGER

(71) Applicant: AstenJohnson International, Inc., Charleston, SC (US)

(72) Inventors: Jill Wilkie, Clinton, SC (US); John Snead, Joanna, SC (US)

(73) Assignee: AstenJohnson International, Inc., Charleston, SC (US)

( * ) Notice: Subject to any disclaimer, the term of this patent is extended or adjusted under 35 U.S.C. 154(b) by 159 days.

(21) Appl. No.: 18/011,976

(22) PCT Filed: Jun. 4, 2021

(86) PCT No.: PCT/US2021/035828

§ 371 (c)(1),
(2) Date: Dec. 21, 2022

(87) PCT Pub. No.: WO2022/010604

PCT Pub. Date: Jan. 13, 2022

(65) Prior Publication Data

US 2023/0272582 A1 Aug. 31, 2023

Related U.S. Application Data

(60) Provisional application No. 63/048,251, filed on Jul. 6, 2020.

(51) Int. Cl.
*D21F 7/10* (2006.01)

(52) U.S. Cl.
CPC ..... *D21F 7/10* (2013.01)

(58) Field of Classification Search
CPC ..... D21F 7/10; D21F 1/0036; D21F 1/0054
See application file for complete search history.

(56) References Cited

U.S. PATENT DOCUMENTS

| | | | |
|---|---|---|---|
| 3,815,645 | A | 6/1974 | Cororniu |
| 4,883,096 | A | 11/1989 | Penven |
| 5,268,076 | A | 12/1993 | Best et al. |
| 5,360,656 | A | 11/1994 | Rexfelt et al. |
| 5,785,818 | A | 7/1998 | Fekete et al. |
| 6,213,164 | B1 | 4/2001 | Ostermayer et al. |

(Continued)

FOREIGN PATENT DOCUMENTS

| | | | |
|---|---|---|---|
| JP | 4272198 | 3/2009 | |
| WO | 2020027996 | 2/2020 | |
| WO | WO-2020027996 A1 * | 2/2020 | ..... D21F 7/083 |

*Primary Examiner* — Dennis R Cordray
*Assistant Examiner* — Matthew M Eslami
(74) *Attorney, Agent, or Firm* — Volpe Koenig

(57) ABSTRACT

A seamed press felt formed from a base fabric having a CD and an MD with opposing MD ends that are joined to form a continuous belt. MD oriented yarns form uniform loops at the opposing MD ends that are interdigitated to define a pintle channel extending across the CD width. CD oriented yarns are connected to the MD oriented yarns, in a woven or non-woven construction. Loop open spaces are located within the loops at the MD ends in a seam region, with the loop open spaces being between the last CD yarn at each MD end and the pintle channel. At least one CD monofilament support yarn is located in the loop open spaces at the MD ends. The at least one CD monofilament support yarn has a diameter that is at least 1.6 times a diameter of the CD oriented yarns.

14 Claims, 7 Drawing Sheets

(56) References Cited

U.S. PATENT DOCUMENTS

| | | | |
|---|---|---|---|
| 7,118,651 | B2 | 10/2006 | Aldrich |
| 7,892,402 | B2 | 2/2011 | Hawes et al. |
| 2012/0145349 | A1 | 6/2012 | Ogilwara |
| 2017/0037573 | A1 | 2/2017 | Postl |
| 2018/0347113 | A1 | 12/2018 | Postl et al. |

* cited by examiner

CONTROL SAMPLE

TRIAL SAMPLE

CONTROL SAMPLE

TRIAL SAMPLE

SEAMED PRESS FELT WITH PARTIALLY ANCHORED STUFFER YARN PACKAGER

INCORPORATION BY REFERENCE

The following documents are incorporated herein by reference as if fully set forth: U.S. Provisional Patent application No. 63/048,251, filed Jul. 6, 2020.

FIELD OF THE INVENTION

The invention generally concerns seamed press felts for use in the manufacture of paper and similar products in a papermaking or like machine. It is particularly concerned with seams for spirally wound, multiaxial press felts formed with four layers. The novel construction assists to reduce sheet marking at the seam.

BACKGROUND

The present invention concerns press felts for use in the press section of papermaking machines. In the manufacture of paper products, a stock slurry consisting of about 1% papermaking fibers and others solids dispersed in about 99% water is delivered at high speed and precision from a headbox slice onto a rapidly moving forming fabric, or between two forming fabrics, in the forming section of a papermaking machine. The stock is subjected to agitation and is dewatered by various means through the forming fabrics, leaving behind a loosely cohesive and wet web of fibers. This web is then transferred to the press section where a further portion of water is removed by mechanical means as the web, supported by one or more press felts, passes through at least one, and usually a series, of press nips where water is essentially squeezed from the nascent sheet and into the press felt. The water is accepted by the press felt and, ideally, does not return to the web. The resulting sheet is then passed to the dryer section which includes a series of rotatable dryer drums, or cans, that are heated by steam. The sheet is directed around and held in contact with the periphery of these drums by one or more dryer fabrics so that the majority of the remaining water is removed by evaporation.

Press felts play a critical role in the manufacture of paper products. The known press felts are produced in a wide variety of styles designed to meet the requirements of the papermaking machines on which they are installed, and the paper grades being manufactured. They are generally assembled using a woven or nonwoven base fabric structure into which is needled one and usually multiple layers of a fibrous nonwoven batt. The batt provides a smooth surface upon which the paper product is conveyed, acts as a reservoir to trap water expressed at the press nip, and provides a measure of resiliency to the press felt as it passes through the nip. The base fabrics are typically woven from monofilament, cabled monofilament, multifilament or similar multicomponent yarns; they may also be arranged as nonwoven planar arrays. The component yarns are usually comprised of an extruded polymeric resin, typically a polyamide.

The base fabrics may be of single layer or multilayer construction, or they may be formed from two or more layers which are laminated together. They may be woven endless, so that the resulting fabric resembles a tube with no seam; such fabrics must be prepared to the length and width of the machine for which they are intended, and must be slipped onto the press section in a manner similar to a sock. An example of such a fabric is provided in U.S. Pat. No. 7,118,651. In a variant modified endless weaving technique, the weft yarns are used to form seaming loops at the widthwise fabric edges during manufacture; when installed on the papermaking machine, these yarns will be oriented in the intended machine direction (MD) allowing the fabric to be joined by bringing the loops from each side together and inserting a pin, or pintle, through the resulting channel formed by the intermeshed loops. An example of a modified endless woven fabric may be found in U.S. Pat. No. 3,815,645. The base fabrics may also be flat woven, using one or more layers of warp or weft yarns; a seam is typically formed at each end allowing the fabric to be joined on the machine. An example of a flat woven base fabric may be found in U.S. Pat. No. 7,892,402. All of the above constructions require that the base fabric be woven to the full width and length of the machine for which they are intended.

In an effort to reduce manufacturing time and costs, so-called "multiaxial fabrics" have recently been introduced for the production of press felts. Multiaxial press felts are well known and are described in U.S. Pat. Nos. 5,360,656; 5,268,076; 5,785,818 and others. The base fabrics of these press felts are comprised of a plurality of spirally wound and edgewise joined turns of a material strip including at least machine direction (MD) oriented yarns. The material strip is usually a flat woven fabric which is narrower than the width of the intended base fabric of which it is a component; it has also been proposed to use nonwoven arrays of MD yarns as the material strip component. Regardless of whether the component is woven or nonwoven, during assembly each turn of the material strip is directed about two opposing rollers such that its component MD yarns are canted at a small angle that is from about 1° to about 8° to the intended MD of the finished fabric; see prior art FIG. 1. Each successive turn of the material strip is edgewise bonded to that laid adjacent to it so as to build up a continuous tube-like base fabric of desired width and length. When removed from the assembly rollers and laid flat, the tube has continuous top and bottom surfaces joined at cross-machine direction (CD) oriented fold regions at each of the two opposing ends; see prior art FIG. 2. The completed multiaxial base fabrics are typically one of a two, three or four layer construction comprising the top and bottom surfaces of the spirally wound continuous tube, and optionally at least one additional flat fabric layer, located either interior to the flattened tube, or on top of one or both exterior surfaces. The assembled base fabrics may later be provided with a seam to facilitate their installation on the machine for which they are intended.

FIG. 3 shows the two opposing edge regions of the spirally wound prior art double layer woven structure of FIG. 2 with a portion of the CD oriented yarns removed at the opposing fold regions. This exposes the MD oriented yarns of the structure so that the yarn loops may be used to form a seam in the fabric as illustrated in FIG. 4. This Figure shows a double layer fabric that has been seamed by intermeshing the yarn loops formed by the MD yarns at the fold region and inserting a pintle across the length of the channel thus provided.

For the seamed press felt, and particularly in the case of multiaxial fabric based press felts, there are several seam related issues. These include differences in the physical characteristics of the fabric in the seam area resulting in different resiliency and different air permeability, which can result in sheet break due to lower strength of the paper sheet at the seam mark, as well as marking of the finished paper. The seam region is thus usually recognized as the most critical area of the finished fabric.

One previously proposed solution was to insert so-called "stuffer yarns" into the base fabric adjacent the seam. These stuffer yarns are usually multicomponent yarns which, due to their larger surface area in comparison to monofilaments, offer greater opportunity for anchorage of the batt material during a needling process to provide more uniformity. However, the results here are inconsistent at best and still leave very perceptible marks on the finished sheet being processed/transported by the press felt.

It would be desirable to provide a press felt base fabric construction which improves upon the known sheet marking issues at the seam, particularly for multiaxial press felt constructions. The seam constructions provided herein address some or all of these issues.

SUMMARY

In one aspect, a seamed press felt is provided that includes a base fabric having a CD width and an MD length with two opposing MD ends that are joined to form a continuous belt. MD oriented yarns form uniform loops at the two opposing MD ends that are interdigitated to define a pintle channel extending the CD width, and CD oriented yarns are connected to the MD oriented yarns. Loop open spaces are located within the loops on each of the two opposing MD ends in a seam region, with the loop open spaces being defined between a last one of the CD yarns at each of the two opposing MD ends and the pintle channel. In order to reduce the seam mark in the finished paper product, a stuffer package is located in the loop open spaces on each of the two opposing MD ends. The stuffer package includes at least one CD stuffer monofilament yarn having a diameter at least as large as a diameter of the CD oriented yarns, and at least two CD cabled monofilaments, each said cabled monofilament including at least 3 monofilament strands. A stitch, preferably in the form of a zig-zag stitch, extends through at least a portion of the stuffer package and a portion of the base fabric at each of the two opposing MD ends. The zig-zag stitch holds the at least one monofilament yarn and a first subset of the at least two cabled monofilaments in place in the loop open spaces, and a second subset of the at least two cabled monofilaments is free-floating in the loop open spaces. A pintle extends through the pintle channel to form a seam.

In one embodiment, a single one of the CD stuffer monofilament yarns is used in the loop open spaces on each of the two opposing MD ends. The single one of the CD stuffer monofilament yarns preferably has a diameter that is about 0.5-1.2 mm.

Alternatively, two of the CD stuffer monofilament yarns are used in the loop open spaces on each of the two opposing MD ends. These CD stuffer monofilament yarns preferably have a diameter that is also about 0.5-1.2 mm.

In one presently preferred arrangement, there are no more than two of the CD stuffer monofilament yarns in the loop open spaces on each of the two opposing MD ends.

In another aspect, the at least two CD cabled monofilaments includes four of the CD cabled monofilaments, and the first subset includes two of the CD cabled monofilaments and the second subset includes the other two of the CD cabled monofilaments.

In each case for use as a papermaking press felt, batt fibers are needled to the base fabric.

Preferably, an air permeability of the press felt across the seam region is within 15% of an air permeability of the press felt outside of the seam region. More preferably, the air permeability of the press felt across the seam region is within 10% of an air permeability of the press felt outside of the seam region.

In one arrangement, the base fabric can be woven. It is also possible for the base fabric to be a non-woven.

In one preferred arrangement, the at least one CD stuffer monofilament is made of polyurethane.

In one preferred arrangement, the at least one CD stuffer monofilament yarn has a diameter of at least 0.5 mm.

In one preferred arrangement, the CD cabled monofilaments have a diameter of at least 0.5 mm.

In embodiments where the press felt is a nonwoven multiaxial press felt, the base fabric may comprise a plurality of spirally wound turns of a first fabric structure, the first fabric structure including a first planar yarn array of the MD oriented yarns comprising single polymeric monofilaments arranged at a first density, at least two layers of a hot melt adhesive web having a first melting temperature, one of the layers of the hot melt adhesive located on each side of the first planar yarn array is used to attach an array of CD oriented yarns. Each adjacent one of the wound turns of the first fabric structure is oriented at an angle to the MD and is bonded to an adjacent turn to provide a flattened continuous double layer tube.

A preferred assembly method provides that the base fabric is collapsed so that it forms a flattened tube with two folded ends and the seam loops are located at the folded ends.

BRIEF DESCRIPTION OF THE DRAWINGS

The foregoing Summary and the following detailed description and claims will be best understood when read in conjunction with the drawings which show the presently preferred embodiments of the invention. In the drawings:

DETAILED DESCRIPTION

Figure 1:
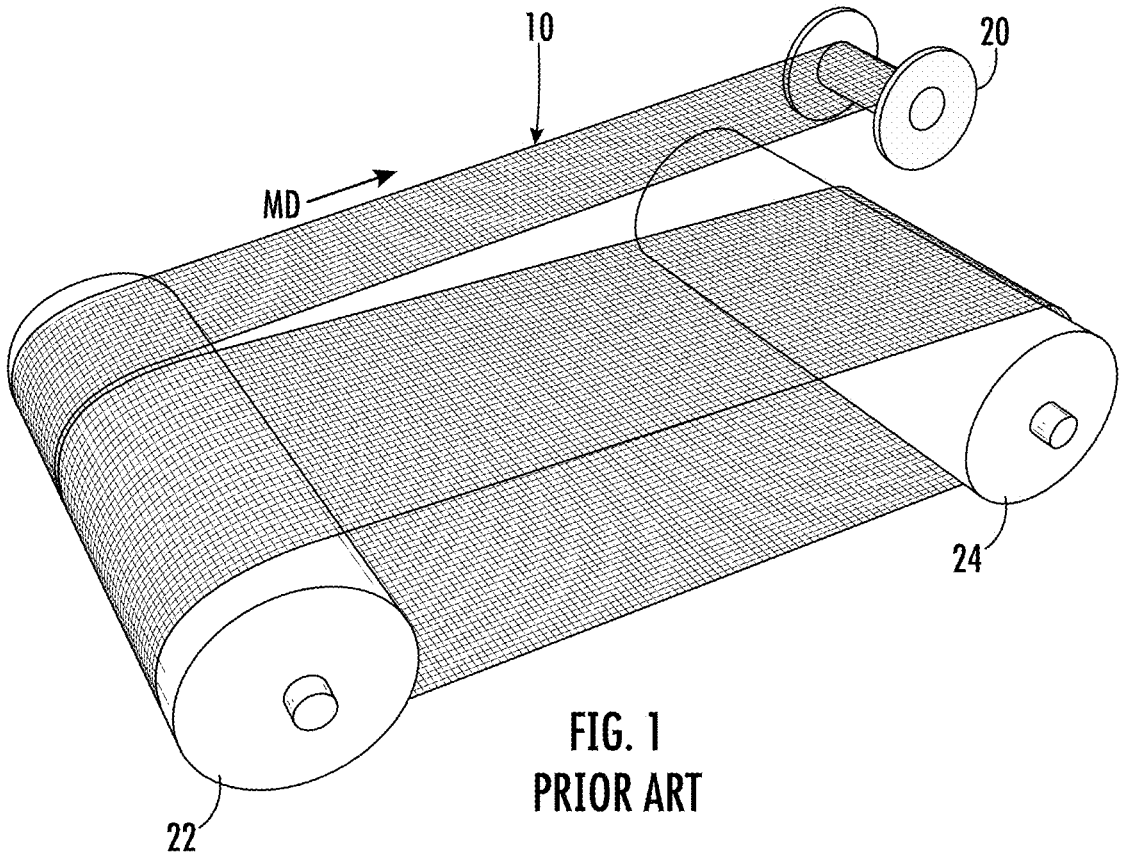
FIG. 1 PRIOR ART
FIG. 1 is an illustration showing a known spiral winding process in which a strip of relatively narrow fabric 10 is spirally wound from a feed source 20 between two opposed rolls 22, 24 to produce a desired width and length of base fabric. Each successive turn of strip 10 is bonded to that to which it is laid adjacent in the process to provide the base fabric.

Certain terminology is used in the following description for convenience only and is not limiting. The words "top," "bottom," "upper" and "lower" designate directions in the drawings to which reference is made. The words "interior" and "exterior" refer to directions within or outside of the two layers of the base fabric. A reference to a list of items that are cited as "at least one of a, b, or c" (where a, b, and c represent the items being listed) means any single one of the items a, b, or c, or combinations thereof. "A" or "an" refer to one or more of the item noted. "MD" refers to a machine direction in the papermaking machine from the headbox to the dryer section and is the longitudinal direction of the press felt. "CD" refers to the cross-machine direction, or a direction perpendicular to the machine direction in the plane of the fabric. The term "PS" refers to the paper side surface of the fabric, which is the surface upon which the paper product is carried through the papermaking machine. "MS" refers to the machine side of the fabric and is the surface opposite to the PS. Unless otherwise specified, the term "yarn" or "yarns" refers to a continuous length of either single or cabled polymeric monofilament such as would be used in the manufacture of the base fabrics, while the term "fiber" or "fibers" refers to relatively small diameter polymeric materials such as those commonly used in batt or scrim materials which fibers have a very small dtex (mass in grams per 10,000 meters of fiber). "Seam region" refers to the exposed yarn loops of the MD yarns at the CD fold areas at the opposing MD ends of the press felt. "Orthogonal" or "perpendicular" as used herein with respect to the CD and MD yarns means generally within about 85° to 95° based on the deviation from true perpendicular created by the spiral winding of the MD yarns in the first yarn array. The terms "left", "right", "up", "down" are used in relation to the drawings and have the meanings usually assigned. The term "about", unless otherwise noted, means +/−10% of the noted value. Additional definitions for terms used herein are as follows:

Additional Definitions:

"Press felt base fabric": a woven or nonwoven assembly of yarns provided as an endless structure or continuous loop including two superimposed layers joined (when laid flat) at two opposing fold areas, including continuous MD yarns passing around the folds. The assemblies can take the form of: a) an endless woven structure, b) a modified endless woven structure, c) a flat woven fabric folded at two locations to provide a double layer assembly, d) a fabric formed according to a multiaxial assembly process, or e) a nonwoven structure assembled to provide any of the previous assemblies. The present invention is applicable to all of the above, but it is particularly suitable for use in both woven and nonwoven multiaxial base fabric constructions. All of the base fabrics, with the possible exception of those which are endless woven, are post processed to provide seam loops formed by the MD oriented component yarns allowing the fabric to be joined and thus rendered endless. These base fabrics provide the finished press felt with the physical properties (strength, void volume, resiliency) necessary for it to survive the rigors of the machine environment in which it will be used, while providing a rugged carrier for the batt fibers.

Figure 2:
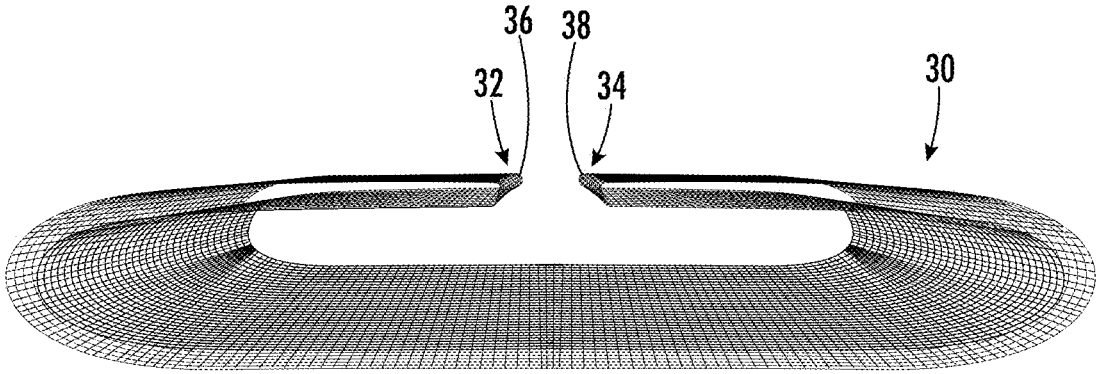
FIG. 2 PRIOR ART
FIG. 2 is a view of a continuous tube-like base fabric 30 including opposing fold regions 32 and 34; fabric 30 may be made from successive turns of the narrow fabric 10 in the manner illustrated in FIG. 1, or it may be produced by a modified endless weaving process, a flat weaving process where opposing ends of the flat woven cloth are joined to provide a continuous tube, or it may be a nonwoven cohesive assembly of yarns oriented in the length direction around the tube.
Figure 3:
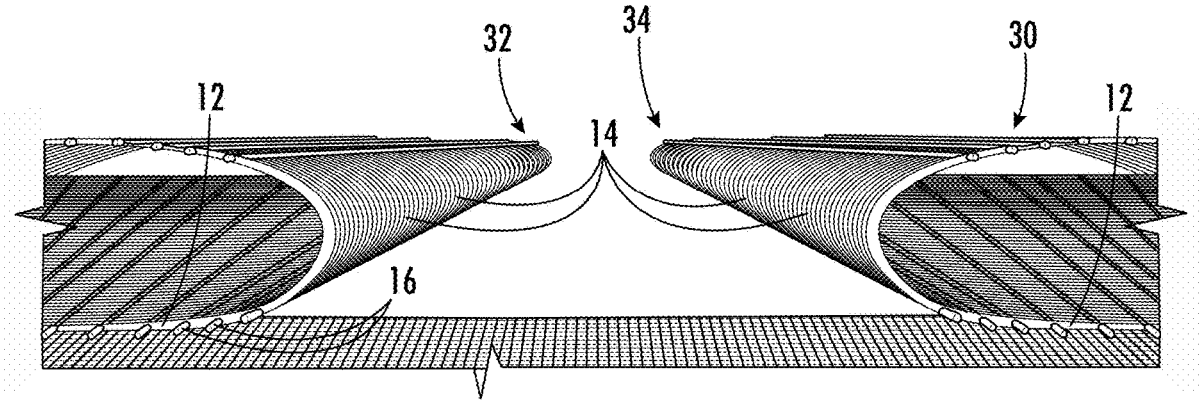
FIG. 3 PRIOR ART
FIG. 3 is an enlargement of the two folded edge regions 32, 34 of the base fabric 30 presented in FIG. 2 which form the seam region in the prior art fabrics shown in FIGS. 1 and 2.
Figure 4:
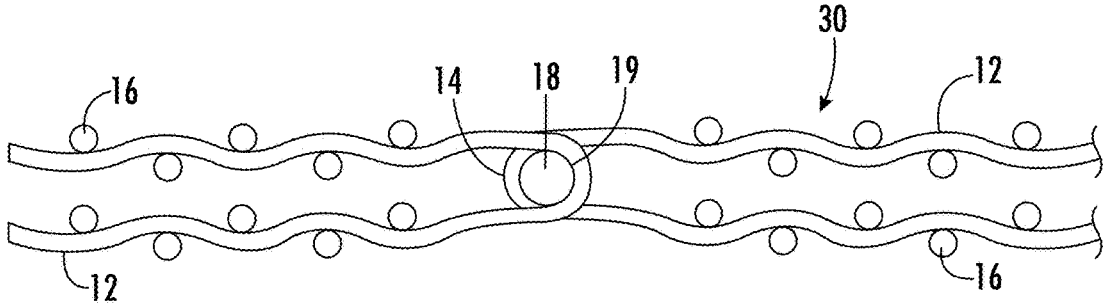
FIG. 4 PRIOR ART
FIG. 4 is a schematic illustration of the seam region in a prior art base fabric such as presented in FIGS. 1 to 3 including a pintle 18 to join the seam regions of the folded ends 32, 34. This is shown prior to needling of one or more batt layers to the base fabric 30.

Referring to FIGS. 1-4, one construction of a press felt base fabric 30 in accordance with the prior art is shown, in this case a multiaxial construction. FIG. 1 shows a strip of material, which can be woven or non-woven and including MD oriented yarns 12 and CD oriented yarns 16, being unwound from a source 20 and wrapped around two rolls 22, 24. The longitudinal edges of the strip are joined together to form a fabric tube. FIG. 2 shows the fabric tube collapsed to form the press felt base fabric 30 having two fold regions 32, 34, that define the fabric ends 36, 38. As shown in FIG. 3, continuous ones of the MD yarns 12 form loops 14 at each of the fold regions 32, 34 at the fabric ends 36, 38 that can be intermeshed in a known manner to form a pintle channel 19 in which a pintle 18 is inserted, as shown in FIG. 4, to form an endless base fabric 30.

In the case of a multiaxial press felt base fabric 30, as well as other double layer base fabrics, the double layer formed by collapsing the fabric tube is connected together in a needling process in which one or more layers of a nonwoven fibrous batt material 28 (shown in FIG. 5) are attached (shown in FIG. 5) to the base fabric 30 in a needling process to form the press felt 31. It is frequently necessary to insert special yarns, commonly referred to as "stuffer yarns" which are small multifilament yarns, to allow better engagement and entanglement with the batt fibers, adjacent the seam region to enable secure attachment of the batt material 28. The fibrous batt material 28 is typically a selected mixture of polyamide fibers such as is known in the art. It is also possible that a portion of these fibers may be bi-component in nature and include an adhesive component which, during subsequent fabric processing, melts to provide improved surface fiber retention and smoothness to the resulting fabric.

After the needling process, it is necessary to again free the yarn loops 14 of excess batt fiber so that the seam region can accommodate the pintle 18 or similar retaining means that is passed through the loops 14 as the finished fabric is joined on the machine for which it is intended. The batt fiber material 28 in this fold region is typically cut and brushed back to form a flap of nonwoven material which is laid back over and reattached at the seam region to minimize any discontinuity there.

The needled press felt 31 is then subjected to heatsetting and various other known finishing steps so as to stabilize it. Following these steps, the finished nonwoven press felt is ready for installation in the press section of a paper machine. The press felt 31 may be installed by passing it through the press section at slow speed while attached to one end of the previous press felt, bringing together the opposed seam regions, intermeshing the loops 14 formed by the MD yarns 12 at the fold regions, and then inserting the pintle 18 or similar joining wire or device through the pintle channel 19 provided at the seam region to close the fabric 31.

Figure 5:
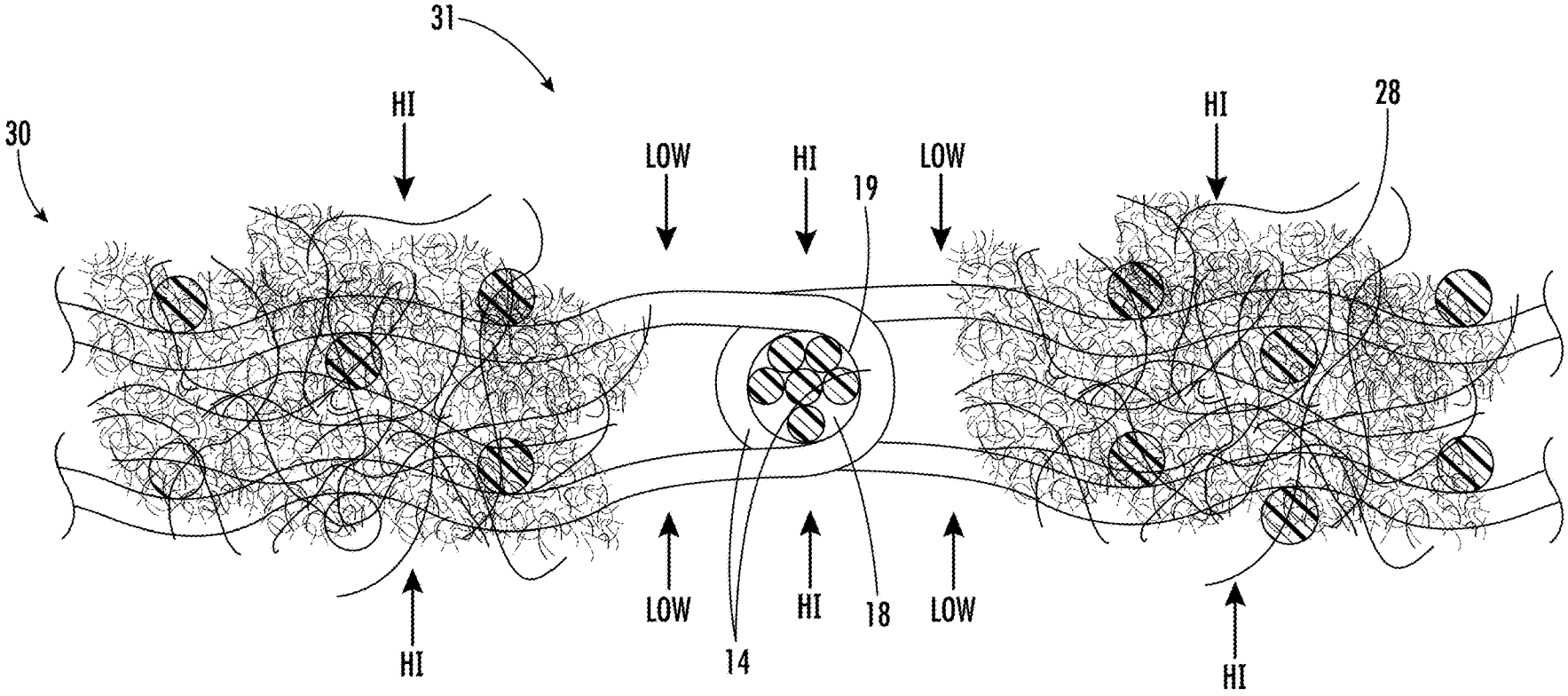
FIG. 5 PRIOR ART
FIG. 5 is a view through the seam region of a press felt 31 formed from the base fabric 30 according to the prior art, with high and low pressure points marked. Here the pintle 19 is formed by a cabled yarn.

FIG. 5 shows a cross-section of the press felt 31 in the area of the seam loops 14 with the needled batt 28 connected to the base fabric 30. In this sample, the pintle 18 is formed as a cabled yarn having multiple monofilaments. As indicated by the arrows in FIG. 5, as the press felt 31 passes through the nip between press rolls, areas of low and high pressure are formed based on the void areas in the press felt 31. Specifically, low pressure areas are formed in the seam region adjacent to the pintle channel 19 through which the pintle 18 is inserted. As discussed above, one previously known method for attempting to normalize this area is to provide stuffer yarns, which are small multifilament yarns intended to allow better engagement and entanglement of the batt fibers in the seam region. However, as discussed below, this still does not adequately address these low pressure regions sufficiently to avoid sheet marking in the seam region which not only results in marking of the paper product produced, but can result in web tears due to the lower tensile strength of the web being formed in the area of the marking.

Figure 6:
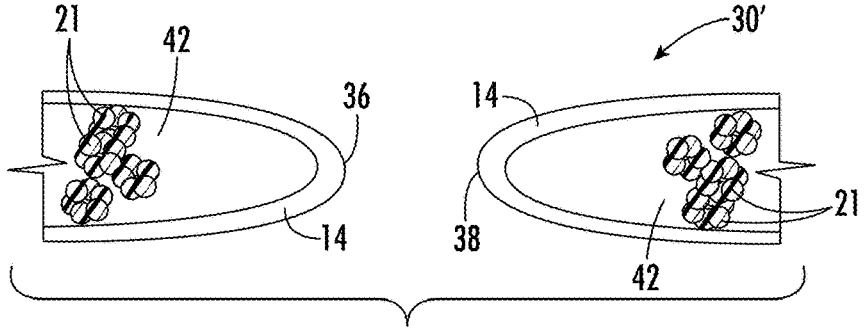
FIG. 6 PRIOR ART
FIG. 6 is a schematic cross-section through two MD ends of a prior art fabric prior to the seam loops being intermeshed for joining by a pintle, with a known stuffer arrangement comprised of cabled monofilament yarns in the loop open spaces.

FIG. 6 shows a schematic cross-section through two MD ends of another prior art fabric 30', which is similar to the base fabric 30 discussed above, prior to the seam loops 14 being intermeshed for joining by a pintle. Here, a known stuffer arrangement comprised of cabled monofilament yarns 21 is provided in the loop open spaces 42.

Figure 7:
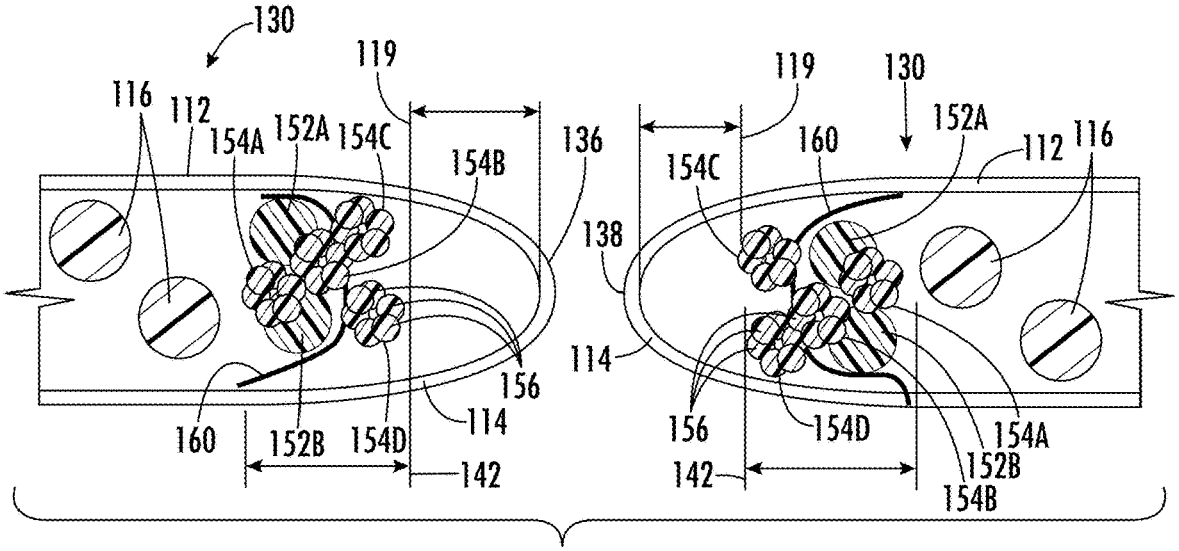
FIG. 7 is a schematic cross-section through two MD ends of an embodiment of a fabric according to the invention prior to the seam loops being intermeshed for joining by a pintle, with a stuffer package according to the invention partially held in place by a zig-zag stitch.
Figure 8:
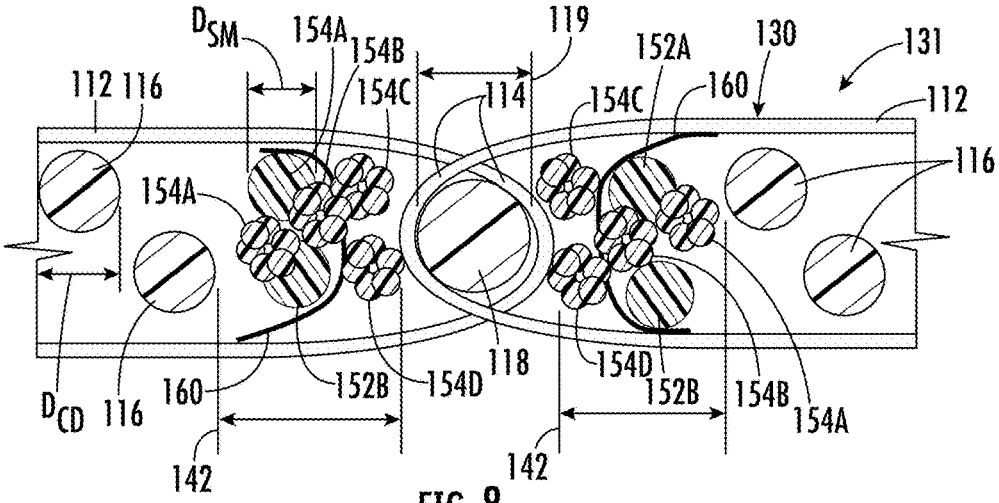
FIG. 8 is a schematic cross-section through the two MD ends of the embodiment of the fabric shown in FIG. 7 with the seam loops being intermeshed and joined by a pintle.

FIGS. 7 and 8 show schematic cross-sections through two MD ends 136, 138 of an embodiment of a press felt 131 formed with a base fabric 130 having a seam region in accordance with the invention. The press felt base fabric 130 is similar to the prior art base fabric 30 discussed above and can be formed by any of the methods noted, and includes MD oriented yarns 112 (similar to 12 above), with MD loops 114 formed at the fabric ends 136, 138, CD oriented yarns 116 (similar to 16 above), as well as a pintle 118 that joins the intermeshed MD loops 114 from the two fabric ends 136, 138 by being inserted through the pintle channel 119 formed by the intermeshed MD loops 114. One or more layers of batt fiber material (not shown but similar to 28) are needled through the base fabric 130 to form the press felt 131. In this case, the base fabric 130 has a CD width and an MD length similar to the prior art fabric 30 and the two opposing MD ends 136, 138 are joined to form a continuous belt.

Figure 9:
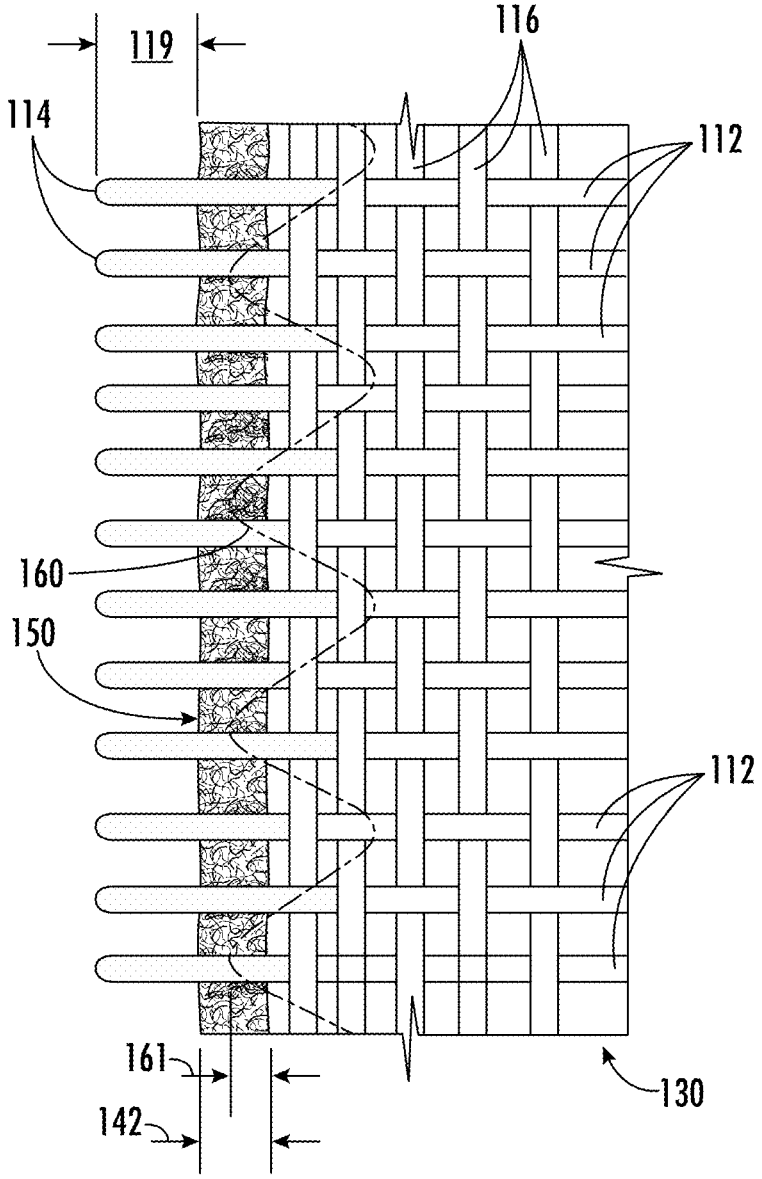
FIG. 9 shows a top view of a portion of one MD end of the embodiment of the fabric shown in FIG. 7.

As shown in FIGS. 8 and 9, loop open spaces 142 are located within the loops 114 on each of the two opposing MD ends 136, 138 in the seam region. The loop open spaces 142 are defined between a last one of the CD yarns 116 at each of the two opposing MD ends 136, 138 and the pintle channel 119. In accordance with the invention, a stuffer package 150 is located in the loop open spaces 142 on each of the two opposed MD ends 136, 138. The stuffer package 150 includes at least one CD stuffer monofilament yarn 152A, 152B having a diameter $D_{SM}$ at least as large as a diameter $D_{CD}$ of the CD oriented yarns 116, and at least two CD cabled monofilaments 154A-D, with each of said CD cabled monofilaments 154A-D including at least three monofilament strands 156. In one arrangement, a single one of the CD stuffer monofilament yarns 152A can be used in loop open spaces 142 on each of the two opposing ends 136, 138. However, in a preferred embodiment, two of the CD stuffer monofilament yarns 152A, 152B are used in the loop open spaces 142 on each of the two opposing MD ends 136, 138. More preferably, there are no more than two of the CD stuffer monofilament yarns 152A, 152B that are used in the loop open spaces 142 on each of the opposing MD ends 136, 138.

Still with reference to FIGS. 7-9, a stitch 160, preferably in the form of a zig-zag stitch, is provided that extends through at least a portion (indicated as 161 in FIG. 9) of the stuffer package 150 and a portion of the base fabric 130 at each of the two opposing MD ends 136, 138. The zig-zag stitch 160 holds the at least one CD stuffer monofilament yarn 152A, 152B and a first subset of the at least two cabled CD monofilaments 154A, 154B in place in the loop open spaces 142, and a second subset of the at least two CD cabled monofilaments 154C, 154D, adjacent to the pintle channel 119, is free-floating in the loop open spaces 142. In a preferred arrangement, the at least two CD cabled monofilaments 154A-154D includes four of the CD cabled monofilaments 154A-154D, and the first subset includes two of the CD cabled monofilaments 154A, 154B, and the second subset includes the other two of the CD cabled monofilaments 154C, 154D. In the connected state of the two MD ends 136, 138, the seam loops 114 are interdigitated and a pintle 118 is placed through the pintle channel 119 to form the seam.

In order to complete the press felt 131, those skilled in the art will recognize that batt fibers 28 (as described above) are needled to the base fabric 130.

The zig-zag stitch 160 has the advantage that part of the stuffer package 150 is held in position and does not float. In comparison to the prior art seamed press felt 31, as the loops 14 are interdigitated, the stuffers 21 floating in the loop open areas 42 are pushed together by the ends of the loops 114 and moved toward the respective bodies of the fabric 30. During needling of the batt 28, this then entangles them against the fabric and accordingly, two much open area remains within the seam region adjacent to the pintle channel 19. In the case of the present invention, by anchoring some of the stuffer package yarns, preferably including the CD stuffer monofilament yarns 152A, 152B as well as a subset of the CD cabled monofilaments 154A, 154B in position, they cannot migrate toward the body of the base fabric 130 when the opposing seam loops 114 are interdigitated.

In the preferred arrangement, an air permeability of the press felt across the seam region is within 15% of an air permeability of the press felt outside the seam region and more preferably is within 10%.

As discussed above, the press felt according to the invention can include a woven base fabric 130 as well as a non-woven base fabric 130.

The monofilament stuffer package 150 prevents the collapse of the MD loops 114 that form the pintle channel 119 and also reduces the elongation of the loops 114 by filling a greater percentage of the loop void area. Further, based on the increased fill provided by the stuffer package 150, the air permeability as well as the pressure become more uniform in the region of the seam, resulting in less seam marking.

Figure 10:
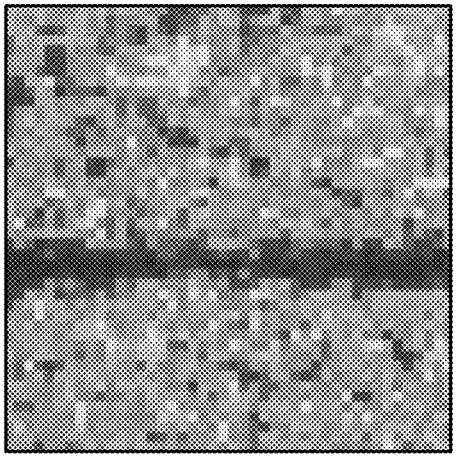
FIG. 10 shows seam quality index graphs generated using a test method which uses pressure sensitive sensor strips to show high and low pressure areas in the seam region. The seam quality index graphs show a visible improvement in the reduction of low pressure areas (the dark areas indicated which were blue in the priority application color drawings) in the seam regions of Trial Sample in comparison to the Control Sample.
Figure 10:
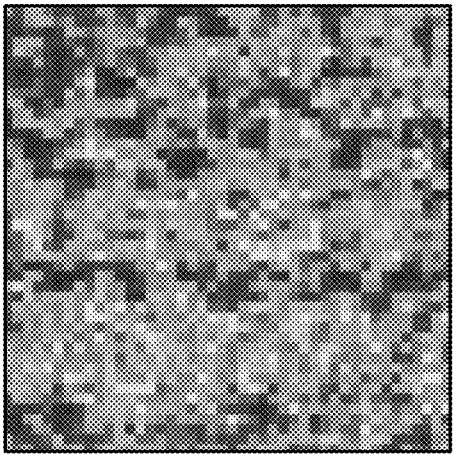

With respect to FIG. 10, an analysis was performed to test the seam quality of a control sample of the press felt 31 in the seam region as well as a trial sample of the press felt 131 in the seam region. The control sample is in accordance with the known prior art utilizing a multifilament stuffer yarn in the loop open spaces 42 as shown in FIG. 6, while trial sample utilizes a stuffer package 150 including two CD stuffer monofilament yarns 152A, 152B having a diameter that is the same as a diameter of the CD oriented yarns 116 (although the diameter could be different), and four CD cabled monofilaments 154A-D, each said CD cabled monofilament including at least 3 monofilament strands, was provided in the loop open spaces 142 on each of the two opposing MD ends 136, 138. The zig-zag 160 stitch held the two CD stuffer monofilament yarns 152A, 152B and two of the CD cabled monofilaments 154A, 154B in position, while two of the CD cabled monofilaments 154C, 154D were allowed to float in the loop open spaces 142.

The graphs in FIG. 10 are a direct measurement of pressure uniformity over the seam area and the dark area (blue in the color photos in the priority application) indicates a low pressure area while the lighter areas represent the higher pressure areas. These represent the potential to mark the sheet being carried by the press felt 131, and the less distinct stripe created by the dark blue areas in the Trial Sample means there is less potential for sheet marking.

Figure 11:
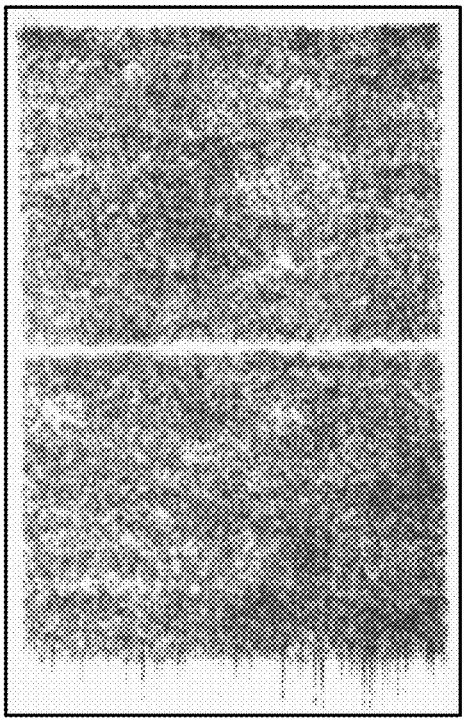
FIG. 11 shows photographs of an imprinted paper sample from the seam region formed on the Control Sample and the Trial Sample according to the invention and illustrates the reduction of the low pressure areas (shown as white areas) in the seam regions of Trial Sample in comparison to the Control Sample.
Figure 11:
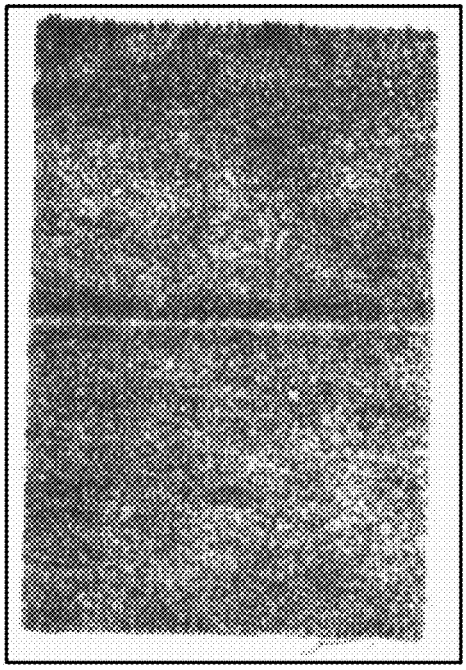

Referring to FIG. 11, the control sample of the press felt 31 as well as the trial sample of the press felt 131 are shown in the seam area. These samples were run in a pilot papermaking machine and a pressure sensitive film was inserted into the nip in the seam area when the samples pass through the nip. The resulted imprinting on each of these samples in the seam region is shown in FIG. 11. As can be seen from the control sample, there is a large white/light area (low pressure area) in the seam region. However, for the trial sample, this white/light area is reduced by 50% or more, and preferably over 75%.

Figure 12:
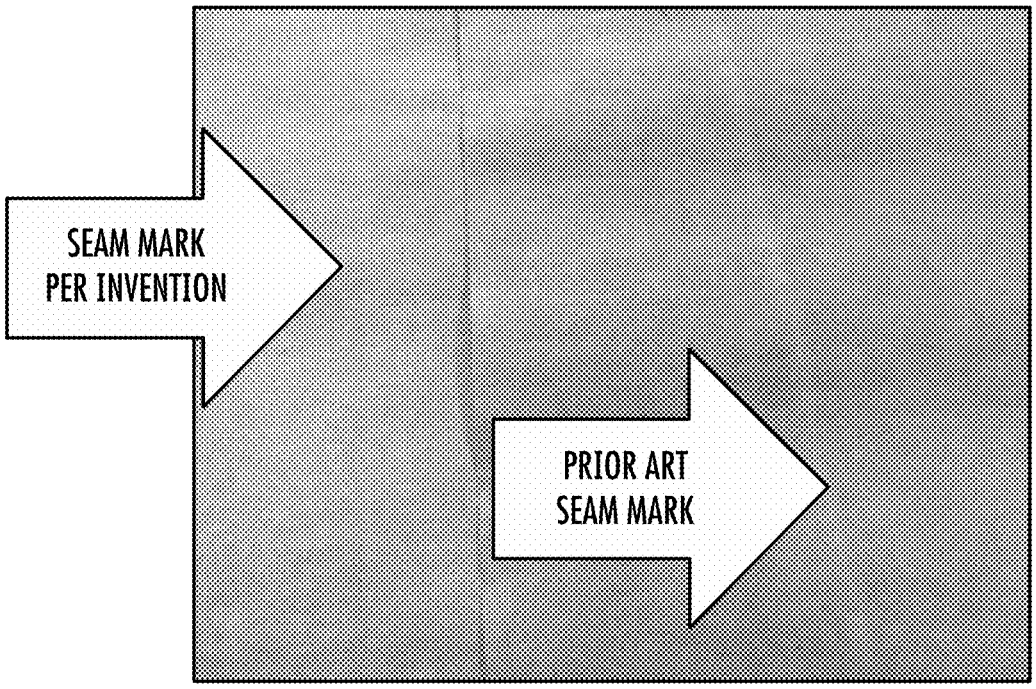
FIG. 12 shows sheet samples of a linerboard in which a visible improvement to the seam mark is provided based on the Trial Sample in accordance with the invention in Comparison to a prior art Control Sample.

FIG. 12 shows linerboard samples without enhancement, where the Prior Art Seam Mark of the Control Sample is visible, while the Seam Mark of the Trial Sample in accordance with the invention is barely visible.

In the preferred embodiments, both the MD yarns 112 and the CD yarns 116 are preferably polyamide monofilaments or cabled yarns. These can be formed of polyamide-6/10 or any other suitable polyamides or co-polymers thereof. Monofilaments formed of polyurethane polymers could also be used. The CD stuffer monofilament yarns 152A, 152B are preferably polyurethane, and preferably have a diameter of 0.5 mm or greater. The CD cabled monofilaments 154A-D are preferably formed of polyamide-6/10, and preferably also have a diameter of 0.15 mm or greater. Exemplary cabled monofilaments could be formed from 0.20 mm diameter monofilaments cabled in a 1×3, 2×3, 2×2, 2×4, 2×5, or 2×6 configuration. The cabled monofilaments could also be formed from 0.15 mm diameter monofilaments cabled in a 1×3, 2×3, 2×2, 2×4, 2×5, or 2×6 configuration. Other suitable polyamides or co-polymers thereof could be used for either or both the CD stuffer monofilament yarns 152A, 152B and the CD cabled monofilaments 154A-D. The zig-zag stitch 160 is also formed of a polyamide.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

The invention claimed is:

1. A seamed press felt comprising:

a base fabric having a CD width and an MD length with two opposing MD ends that are joined to form a continuous belt;

MD oriented yarns form uniform loops at the two opposing MD ends that are interdigitated to define a pintle channel extending the CD width;

CD oriented yarns connected to the MD oriented yarns;

loop open spaces located within the loops on each of the two opposing MD ends in a seam region, the loop open spaces being defined between a last one of the CD yarns at each of the two opposing MD ends and the pintle channel;

a stuffer package located in the loop open spaces on each of the two opposing MD ends, the stuffer package including at least one CD stuffer monofilament yarn having a diameter at least as large as a diameter of the CD oriented yarns, and at least two CD cabled monofilaments, each said CD cabled monofilament including at least 3 monofilament strands;

a stitch that extends through at least a portion of the stuffer package and a portion of the base fabric at each of the two opposing MD ends, the stitch holds the at least one CD stuffer monofilament yarn and a first subset of the at least two CD cabled monofilaments in place in the loop open spaces and a second subset of the at least two CD cabled monofilaments is free-floating in the loop open spaces; and a pintle extending through the pintle channel to form a seam.

2. The press felt according to claim 1, wherein a single one of the CD stuffer monofilament yarns is used in the loop open spaces on each of the two opposing MD ends.

3. The press felt according to claim 1, wherein two of the CD stuffer monofilament yarns are used in the loop open spaces on each of the two opposing MD ends.

4. The press felt according to claim 1, wherein no more than two of the CD stuffer monofilament yarns are used in the loop open spaces on each of the two opposing MD ends.

5. The press felt according to claim 1, wherein the at least two CD cabled monofilaments includes four of the CD cabled monofilaments, and the first subset includes two of the CD cabled monofilaments and the second subset includes the other two of the CD cabled monofilaments.

6. The press felt according to claim 1, further comprising batt fibers needled to the base fabric.

7. The press felt according to claim 1, wherein an air permeability of the press felt across the seam region is within 15% of an air permeability of the press felt outside of the seam region.

8. The press felt according to claim 1, wherein an air permeability of the press felt across the seam region is within 10% of an air permeability of the press felt outside of the seam region.

9. The press felt according to claim 1, wherein the stitch is a zig-zag stitch.

10. The press felt according to claim 1, wherein the base fabric is woven.

11. The press felt according to claim 1, wherein the base fabric is non-woven.

12. The press felt according to claim 1, wherein the at least one CD stuffer monofilament is made of polyurethane.

13. The press felt according to claim 1, wherein the at least one CD stuffer monofilament yarn has a diameter of at least 0.5 mm.

14. The press felt according to claim 1, wherein the CD cabled monofilaments have a diameter of at least 0.15 mm.

* * * * *